US005909810A

United States Patent [19]

Aslam et al.

[11] Patent Number: 5,909,810

[45] Date of Patent: Jun. 8, 1999

[54] APPARATUS FOR PACKAGING AND INSTALLATION OF A FUSING BELT

[75] Inventors: Muhammed Aslam, Rochester; Socrates Hryhorenko, Sodus, both of N.Y.

[73] Assignee: Eastman Kodak Company, Rochester, N.Y.

[21] Appl. No.: 08/992,745

[22] Filed: Dec. 17, 1997

[51] Int. Cl.[6] ..... B65D 69/00

[52] U.S. Cl. ..... 206/576; 206/415; 206/702

[58] Field of Search ..... 206/303, 408, 206/413, 415, 416, 576, 702

[56] References Cited

U.S. PATENT DOCUMENTS 3,888,577 6/1975 Meyer .
4,811,839 3/1989 Cornell et al. .
5,119,133 6/1992 Swain .
5,256,507 10/1993 Aslam et al. .
5,400,121 3/1995 Foote .
5,417,322 5/1995 Jeran et al. .

*Primary Examiner*—David T. Fidel
*Attorney, Agent, or Firm*—Lawerence P. Kessler

[57] ABSTRACT

Packaging for a fusing belt of a belt fusing apparatus for providing image gloss to a colorant image, the belt fusing apparatus including a fuser assembly having a fuser roller and a steering roller about which said fusing belt is adapted to be entrained for movement about a closed loop path defined by the fusing roller and the steering roller. The fusing belt packaging includes a protective shell, and a support within the protective shell. The support is adapted to secure at least a fusing belt and prevent damage thereto during shipping and handling. To install the fusing belt, the protective shell and the support is aligned with the fusing roller and steering roller of a belt fusing assembly. A pair of guide members, having respective tabs, is used to move the fusing belt from the support onto the fusing roller and the steering roller.

3 Claims, 3 Drawing Sheets

APPARATUS FOR PACKAGING AND INSTALLATION OF A FUSING BELT

CROSS REFERENCE TO RELATED APPLICATIONS

U.S. patent application Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent application Ser. No. 08/992,057, filed Dec. 17, 1997, entitled "BELT FUSING ACCESSORY WITH SELECTABLE FUSED IMAGE GLOSS" in the name of Muhammed Aslam et al.

U.S. patent application Ser. No. 08/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent application Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 08/992,946, filed Dec. 17, 1997, now Pat. No. 5,842,099 entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent application Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 08/992,056, filed Dec. 17, 1997, entitled "MECHANISM FOR TRACKING THE BELT OF A BELT FUSER" in the name of Muhammed Aslam et al.

U.S. patent application Ser. No. 08/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

FIELD OF THE INVENTION

This invention is directed in general to a fusing apparatus for a reproduction apparatus, and more particularly to apparatus for packaging and installation of a fusing belt in a belt fusing apparatus.

BACKGROUND OF THE INVENTION

Typical commercial reproduction apparatus include electrostatographic process copier/duplicators or printers, inkjet printers, and thermal printers. With such reproduction apparatus, pigmented marking particles, ink, or dye material (hereinafter referred to commonly as marking particles) are utilized to develop an image, of information to be reproduced, on a dielectric support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to be optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for lack marking particle images may significantly impair legibility, a matte finish is referred.

It is known that the glossiness of a marking particle image is, at east in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing. It is, of course, important to provide for suitable protective packaging and easy installation for the elongated web for the belt fusing apparatus.

SUMMARY OF THE INVENTION

In view of the above, this invention is directed to packaging for a fusing belt of a belt fusing apparatus for providing image gloss to a colorant image, the belt fusing apparatus including a fuser assembly having a fuser roller and a steering roller about which said fusing belt is adapted to be entrained for movement about a closed loop path defined by the fusing roller and the steering roller. The fusing belt packaging includes a protective shell, and a support within the protective shell. The support is adapted to secure at least a fusing belt and prevent damage thereto during shipping and handling. To install the fusing belt, the protective shell and the support is aligned with the fusing roller and steering roller of a belt fusing assembly. A pair of guide members, having respective tabs, is used to move the fusing belt from the support onto the fusing roller and the steering roller.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
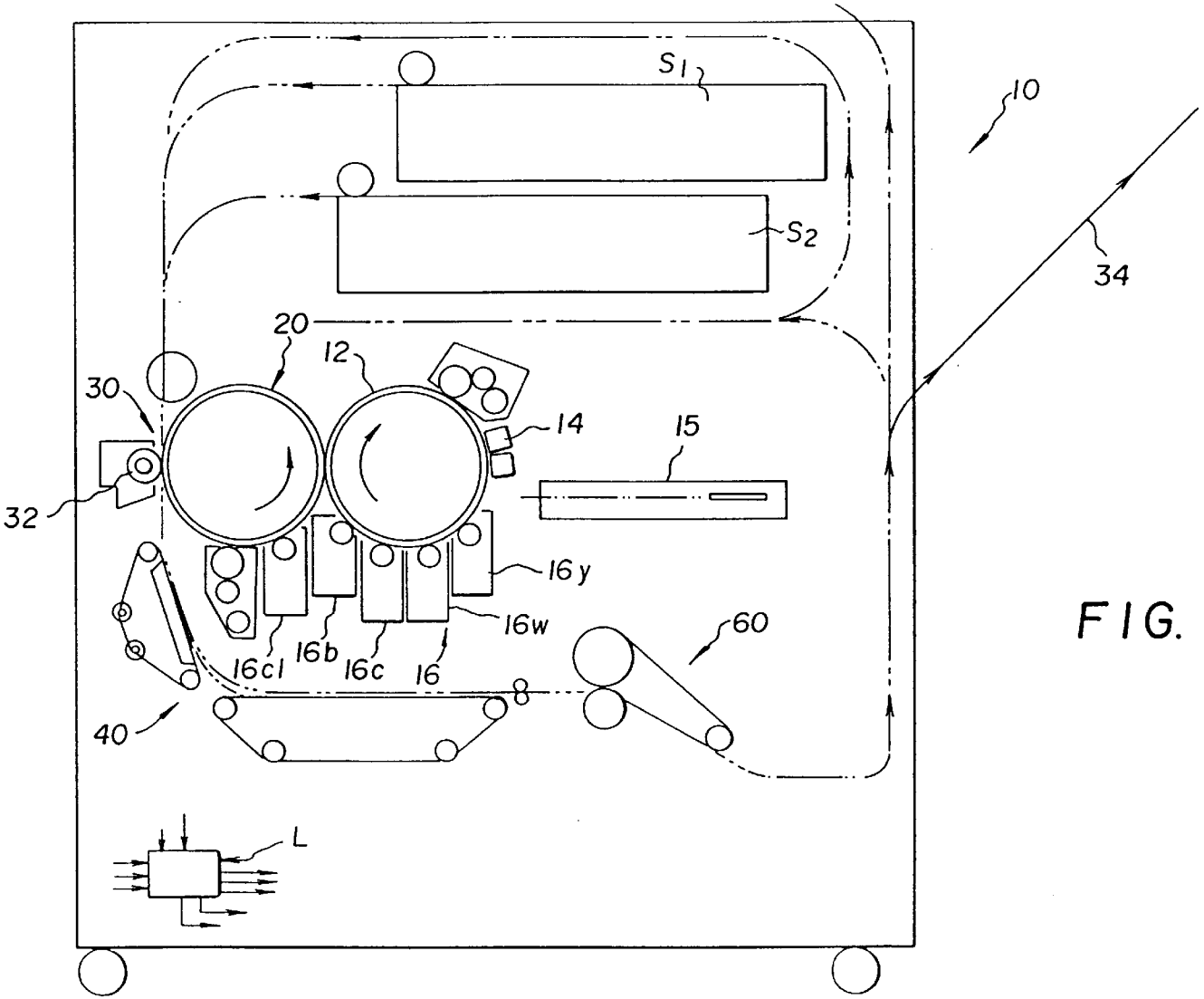
FIG. 1 is a front elevational view of an electrostatographic reproduction apparatus including a belt fusing apparatus utilizing the fuser belt packaging and installation according to this invention.

Referring now to the accompanying drawings, an electrostatographic reproduction apparatus, designated generally by the numeral 10, is shown in FIG. 1. While the reproduction apparatus 10 is shown as an electrophotographic type reproduction apparatus, it is readily appreciated that the belt fusing apparatus is suitable for use with other types of reproduction apparatus, such as ink jet printers and thermal printers.

The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged, and then exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16cl is provided, containing clear marking particles, which is utilized to aid in improving the quality and gloss of reproduced images, in the manner more fully described in the copending U.S. patent application Ser. No. 08/992,872, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The belt fusing apparatus 60, according to this invention, is shown as being integral with the reproduction apparatus 10. The belt fusing apparatus 60 includes an input transport for delivering marking particle image-bearing receiver members to a fusing assembly, designated generally by the numeral 62. The fusing assembly 62 comprises a fusing belt 64 entrained about a heated fusing roller 66 and a steering roller 68, for movement in a predetermined direction about a closed loop path. The fusing belt 64 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

A pressure roller 70 is located in nip relation with the heated fusing roller 66. A flow of air is directed at the area 72 of the belt run upstream of the steering roller 68 and adjacent to the steering roller to cool such area. The cooling action provides for a commensurate cooling of a receiver member, bearing a marking particle image, while such member is in contact with the fusing belt 64. The cooling action for the receiver member serves as the mechanism to substantially prevent offset of the marking particle image to the pressure roller.

Figure 2:
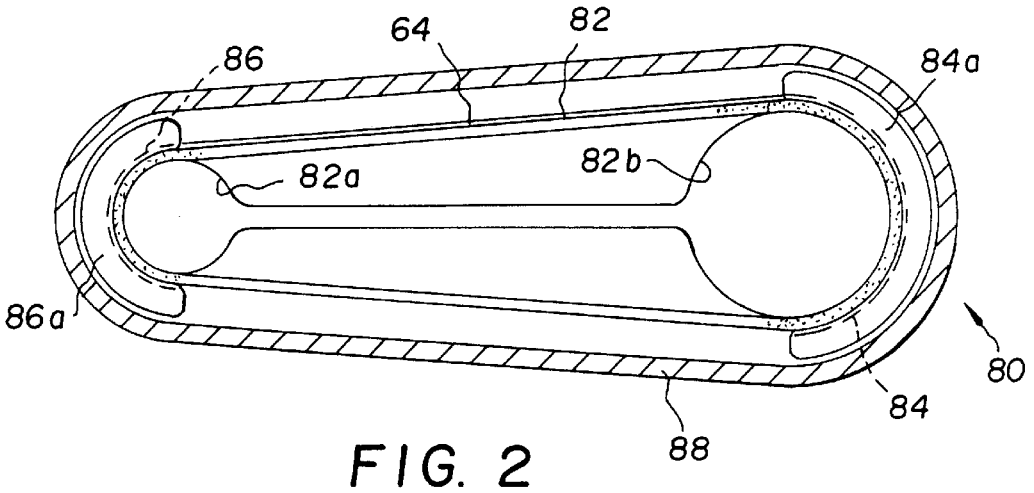
FIG. 2 is a front elevational view, partly in cross-section and on an enlarged scale, of the fuser belt packaging according to this invention.
Figure 3:
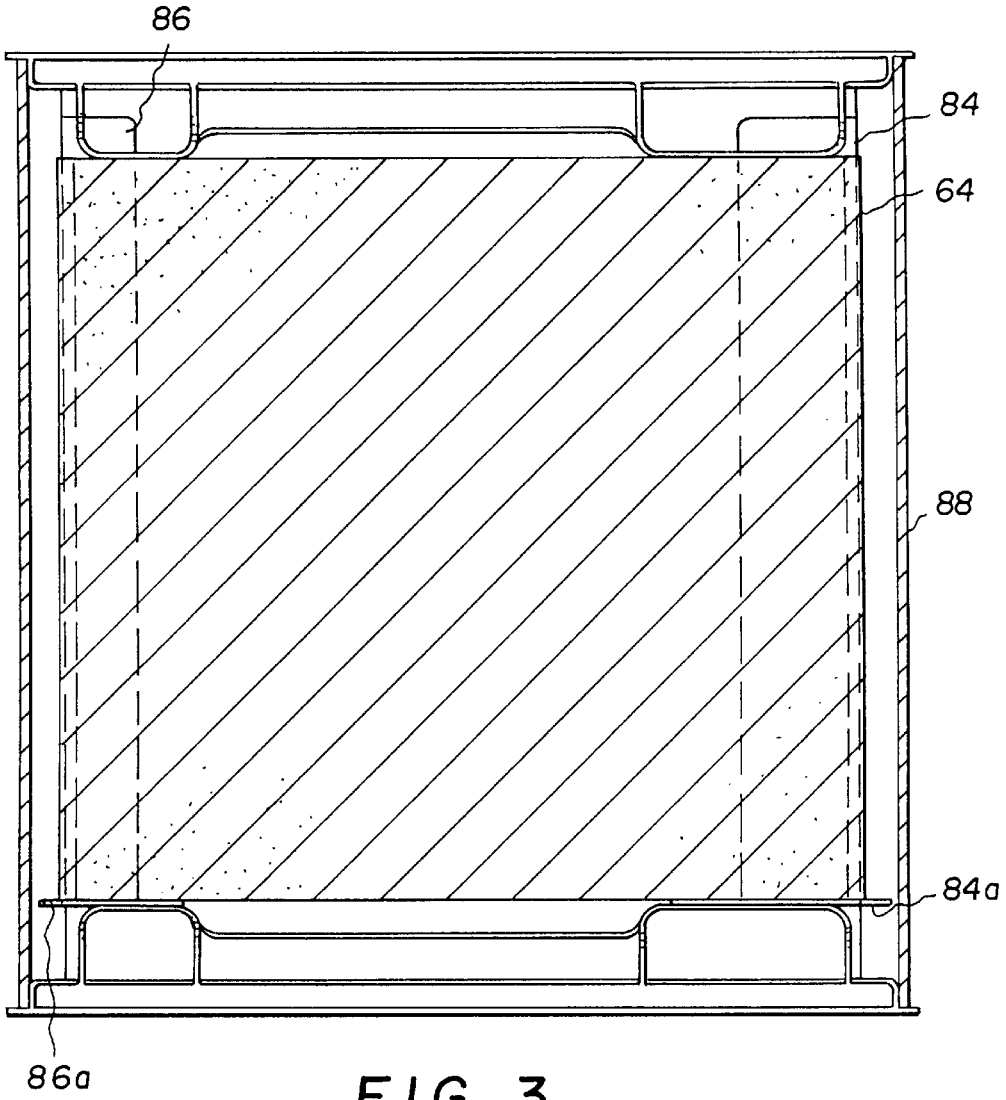
FIG. 3 is a top plan view, partly in cross-section and on an enlarged scale, of the fuser belt packaging according to this invention.

According to this invention, packaging for the fusing belt 64 is provided which is both protective and facilitates installation of the fuser belt onto the fuser assembly 62. The fuser belt packaging, designated generally by the numeral 80, is best shown in FIGS. 2 and 3. The packaging 80 includes an inner core 82 which is formed, for example, of a plastic molded part or of a sheet metal fabrication with a smooth outer surface where the fusing belt is to be supported. The inner core 82 has two cut outs 82*a*, 82*b* of the size of the fuser roller 66 and the steering roller 68 respectively. Alternatively, the inner core could simply define a shell of the shape of the fuser belt. Guides 84, 86 are adapted to be received, under the fuser belt 64, respectively adjacent to the curved ends of the inner core 82, when the fuser belt is placed over the inner core. The guides 84, 86 have respective tabs 84*a* and 86*a* which facilitate handling of the guides. An outer protective shell 88 is made, for example, of some rigid plastic material so as to protect the fuser belt 64 during shipping and handling.

In order to install the fuser belt on a fusing assembly 62, after the protective outer shell 88 is removed, the user need only to simply align the inner core 82 (or cutouts 82*a*, 82*b*) with the fusing roller 66 and the steering roller 68 of the fuser assembly 62, and slide the fuser belt 64 onto the fusing roller and the steering roller. The sliding of the fuser belt onto the fusing roller and the steering roller is facilitated by manual engagement of the tabs 84*a*, 86*a* of the guides 84, 86 to push the guides over the respective fuser and steering rollers. After the fuser belt 64 is on the fuser assembly 62, the rollers and fuser belt are rotated slightly so that the guides 84 and 86 are no longer positioned between the fuser belt and the associated fusing and steering rollers. The guides are thus freed so as to then be easily removable from the fuser assembly 62. The inner core 82, guides 84, 86, and the outer core 88 may be collected and reused repeatedly for shipping and installing fusing belts on a fusing assembly.

Figure 4:
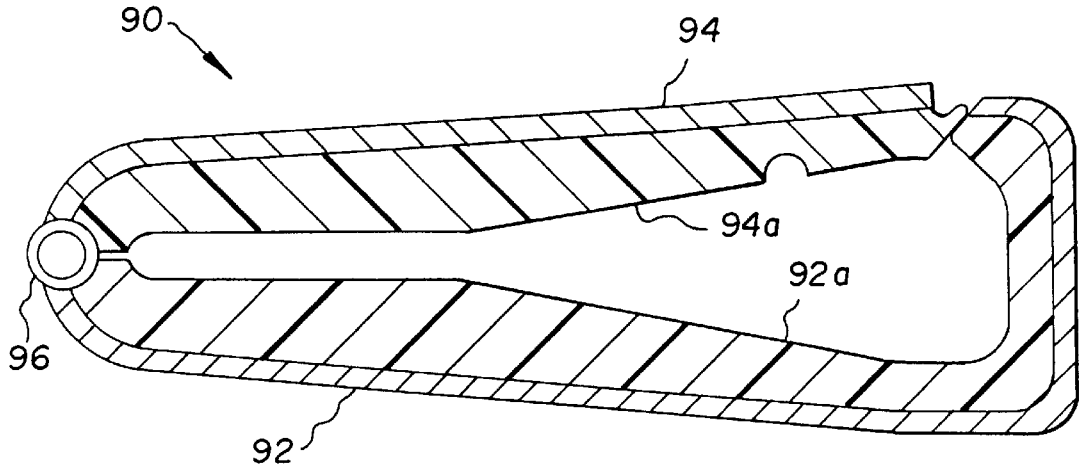
FIG. 4 is a front elevational view, partly in cross-section and on an enlarged scale, of an alternate embodiment for the fuser belt packaging according to this invention.
Figure 5:
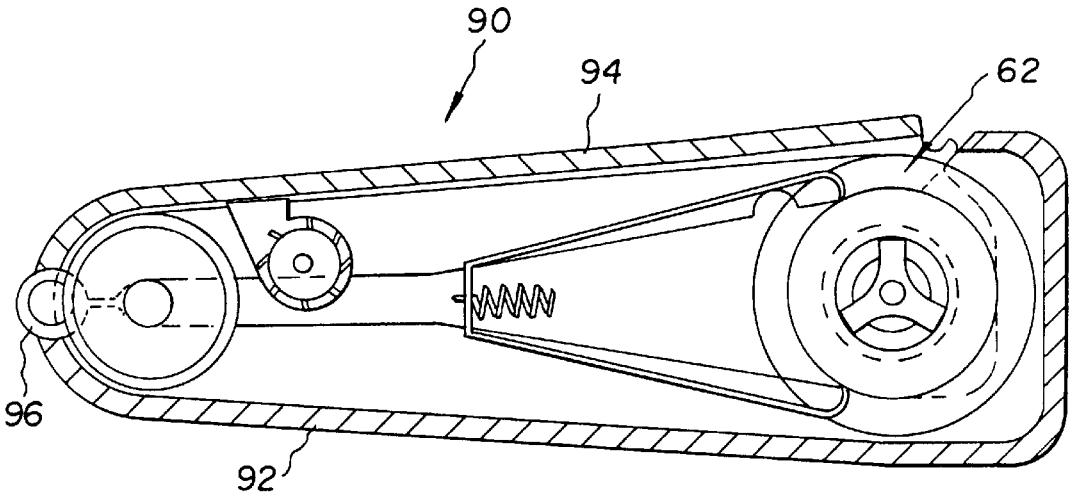
FIG. 5 is a front elevational view, partly in cross-section and on an enlarged scale, of the alternate embodiment for the fuser belt packaging, shown in FIG. 4, shown as containing a fuser assembly and fuser belt.

An alternative packaging, designated generally by the numeral 90, is best shown in FIGS. 4 and 5. The packaging 90 is of the clam shell type and is adapted to contain an entire fuser assembly 62, including the fuser belt 64. The packaging 90 includes a base member 92 and a movable cover member 94. The cover member 94 is supported at a fulcrum point from the base member 92 by a pin 96. The base member 92 and cover member 94 have respective interior configurations molded to secure a complete fuser assembly 62 with a fusing belt 64 ready for easy replacement in the belt fuser apparatus 60 of the reproduction apparatus 10 (or any other suitable fuser apparatus). When the cover 94 of the packaging 90 is pivoted about pin 96 to the open position, the fusing assembly 62 may be taken out and readily placed in the fuser apparatus. The packaging 90 thus serves to secure the fusing belt 64 and other parts of the fusing assembly 62 thereby protecting it from any damage during shipping or handling, and enables the fusing assembly to be easy loaded into the reproduction apparatus, even by an untrained individual.

The invention has been described in detail with particular reference to certain preferred embodiments thereof, but it will be understood that variations and modifications can be effected within the spirit and scope of the invention.

What is claimed is:

1. Packaging for a fusing belt of a belt fusing apparatus for providing image gloss to a colorant image, said belt fusing apparatus including a fuser assembly having a fuser roller and a steering roller about which said fusing belt is adapted to be entrained for movement about a closed loop path defined by said fusing roller and said steering roller, said packaging comprising:

a protective shell; and a support within said protective shell, said support including a core having an external surface shape substantially corresponding to the defined closed loop path so as to securely support a fusing belt thereon, and a guide, receivable between said core and a fusing belt supported thereon, having a tab for facilitating removal of a fusing belt from said core by movement of said guide member tab relative to said core, whereby said support secures at least a fusing belt and prevent damage thereto during shipping and handling and enables ready removal therefrom.

2. The packaging of claim 1 wherein said external core surface has curved end portions joined by substantially straight portions, and said guide includes a pair of members locatable adjacent to said curved end portions.

3. The packaging of claim 2 wherein pair of guide members respectively include tabs for facilitating removal of a fusing belt from said core by movement of said guide member tabs.

* * * * *